US006004184A

United States Patent [19]

Piluso

[11] Patent Number: 6,004,184

[45] **Date of Patent: *Dec. 21, 1999**

[54] DEVICE FOR OBTAINING THE CONTINUOUS REVOLUTION AT A VARIABLE SPEED OF A BODY ABOUT A STATIONARY CENTER

[76] Inventor: Rosario Piluso, Via Giuseppe Pitré, 1, 95041 Caltagirone (CT), Italy

[ * ] Notice: This patent issued on a continued prosecution application filed under 37 CFR 1.53(d), and is subject to the twenty year patent term provisions of 35 U.S.C. 154(a)(2).

[21] Appl. No.: 08/945,052

[22] PCT Filed: Apr. 22, 1996

[86] PCT No.: PCT/IT96/00079

§ 371 Date: Oct. 15, 1997

§ 102(e) Date: Oct. 15, 1997

[87] PCT Pub. No.: WO96/32991

PCT Pub. Date: Oct. 24, 1996

[30] Foreign Application Priority Data

Apr. 20, 1995 [IT] Italy ..... RM95A0255

[51] Int. Cl.[6] ..... A63H 1/00

[52] U.S. Cl. ..... 446/266

[58] Field of Search ..... 446/236, 246, 446/247, 486, 266

[56] References Cited

U.S. PATENT DOCUMENTS 3,655,190 4/1972 Lemon ..... 273/95 A

FOREIGN PATENT DOCUMENTS 903 863 4/1986 Belgium .

2 583 295 12/1986 France .

*Primary Examiner*—Paul J. Hirsch

*Assistant Examiner*—Michael B. Priddy

*Attorney, Agent, or Firm*—DeLio & Peterson, LLC

[57] ABSTRACT

A device for rotating a body comprising a hollow member for grasping in a horizontal position; a constraint having three continuous portions, a first portion extending from a first end of the hollow member, a second portion extending through the hollow member, and a third portion extending from a second end of the hollow member; and a body attached to the first portion of the constraint. An operator oscillates the body in a pendular motion and sets the body in continuous revolution by abruptly pulling and releasing the third portion of the constraint to shorten and lengthen the first portion of the constraint. The third portion of the constraint is pulled when the body is moving below the horizontal plane and released when the body is moving above the horizontal plane. Continuous revolution is achieved by the constant pulling and releasing of the constraint. The body is preferably a ball, small aeroplane or rocket covered with a soft material wherein the device is used as a toy.

5 Claims, 4 Drawing Sheets

DEVICE FOR OBTAINING THE CONTINUOUS REVOLUTION AT A VARIABLE SPEED OF A BODY ABOUT A STATIONARY CENTER

This invention refers to a device for converting a linear movement in opposite direction into a rotary motion along an eccentric orbit, which device can have a plurality of uses and, in this application, will be described and illustrated through an example mainly intended as an amusing toy.

The invention consists of causing a body to rotate and continuously maintain its revolution about a stationary center, acting on the "constraint" that makes this generally rotary motion possible.

The applicant has empirically verified that by abruptly rythmically modifying the lenght of the constraint securing the body to its center of revolution, this revolution can be increased relatively to both its angular speed and its duration.

In this illustrative embodiment the length of the constraint is varied by using a string as a constraint and suitably modifying the length of the string, to the end of which the body to be rotated is secured.

Therefore, according to this embodiment intended as a toy, the device of the invention comprises a body, a string and a shorts length of a pipe or sleeve in the bore of which the string is fitted so as to form therealong three continuous but distinct lengths of the string, and more precisely a length running within the sleeve and two lengths protruding from the mouths thereof. The body to be rotated, which can be for example in the form of a small ball, a small aeroplane, a rocket and the like, is secured to the end of one of these lengths, which from now on is called the outer string length.

With such an arrangement, the sleeve mouth from which the outer string length protrudes is the center or origin of revolution of the string-body system, as it will be more particularly described.

In use, substantially maintaining the sleeve in a generally horizontal stationary position, for example keeping it in one hand, while grasping with the other hand the string length protruding from the sleeve mouth opposite to the mouth defined as the center of revolution of the system, which string length will be called from now on the inner string length, the body will be caused to oscillate with a pendular movement. It has been found that, with the body so oscillating with a pendular movement, any "pulling" and "releasing" action exerted on this inner string length by the relative hand and the consequent lengthening and shortening of the outer string length that secures the body to its center of revolution will cause the body to start rotating and continuously rotate at an angular speed varying from a minimum to a maximum value according to the intensity of the pulling and releasing action exerted on the inner string length.

These being the premises, a more careful study will show that the motion of the body occurs along eccentric or generally elliptical orbits having a variable dimension, wherein the sleeve mouth is the fulcrum of the outer string length, which fulcrum is one of the focuses thereof, the orbits lying in the vertical plane passing through the sleeve mouth and normal to the axis of the latter.

As it will be evident, in other future possible uses of the invention, the length of pipe or sleeve can be horizontally secured to any support, such as a stand, a pole, a framework and the like, while the action exerted by the free hand on the inner string length i n the toy can be replaced by a pulling and releasing action exerted, for example, by an eccentric or a system of eccentrics.

As it will be more particularly described, in both cases the pulling and releasing action exerted either by the eccentric or the system of eccentrics will have to be synchronized "in phase" with the position of the body along the orbit, depending on the position being above or below the horizontal plane passing through the center or origin of revolution.

The motion occurs about the center or origin of the rotary motion, which center generally consists of a hole, a vent or a mouth from which the outer string length to the end of which the body is secured is protruding.

From the foregoing it is evident that through this invention it is possible to obtain that the rectilinear movements in opposite direction applied to a string having a body secured to one end thereof, and fitted in the length of a pipe cause and control a rotary motion of the same body according to substantially eccentric or elliptical orbits.

The invention will be now described in more details with reference to the annexed drawings, wherein:

FIG. 1 schematically shows the toy in action, the body being in the form of a small ball;

Figure 1:
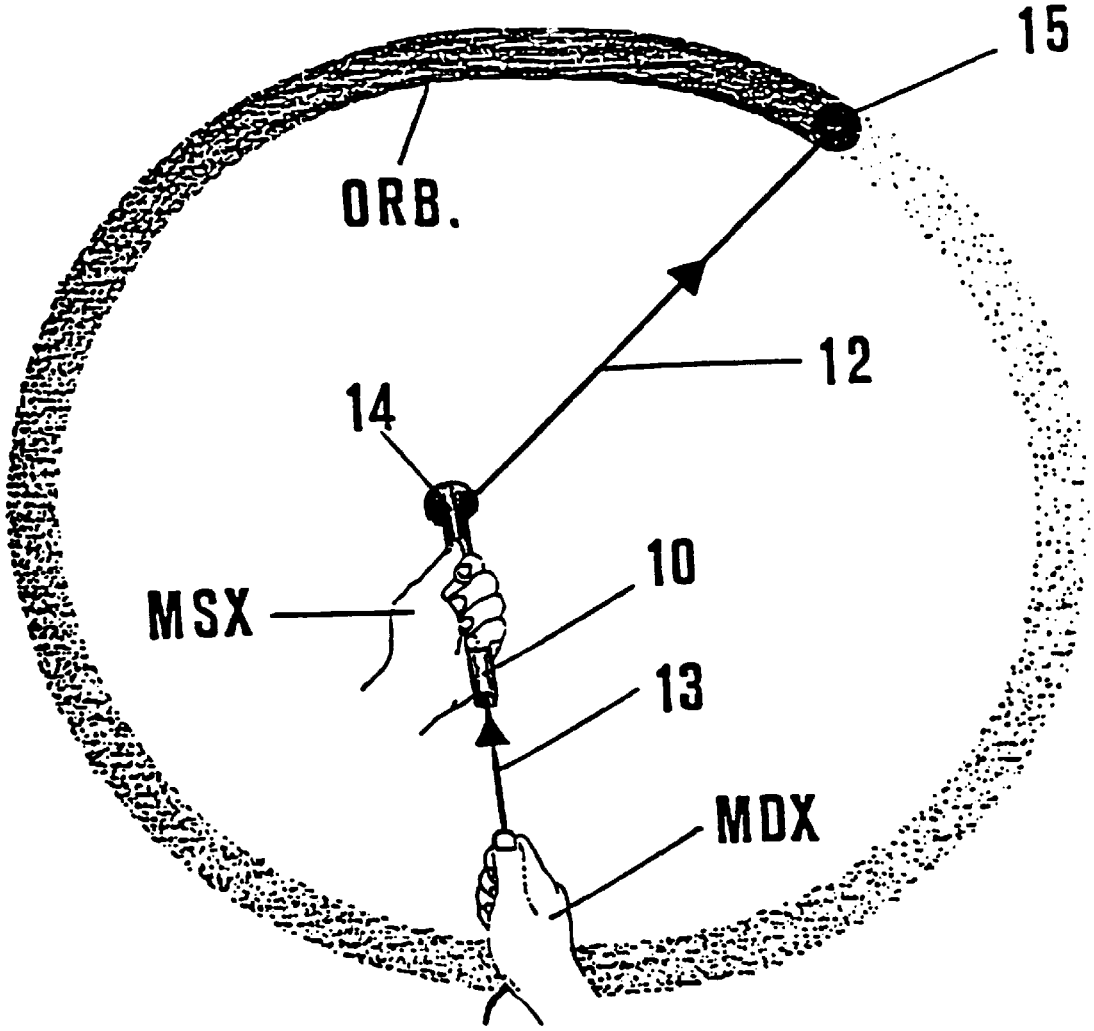

FIGS. 4–7 schematically show four steps or moments of the body motion along its eccentric orbit, depending on the pulling or releasing action exerted on the string.

It should be noted at this point that in all the figures the reference numbers indicate the relative elements of the invention as follows:

10 the length, of pipe or sleeve;

11 the string length fitted in the sleeve length;

12 the string length protruding from the mouth of sleeve 10, which mouth is the canter of revolution of the system (or outer string length);

13 the string length protruding from the sleeve mouth opposite to the mouth defined as the center of rotation (or inner string length);

14 the sleeve mouth from which the outer string length protrudes (or center of revolution);

15 the body secured to the end of the outer string length,

MDX the right hand of the toy user;

MSX the left hand;

PVT the vertical plane passing through sleeve mouth 14 and normal to the axis of sleeve 10.

TPO the path on the plane of the drawing of the horizontal plane passing through mouth 14 and containing the length of pipe or sleeve.

Figure 5:
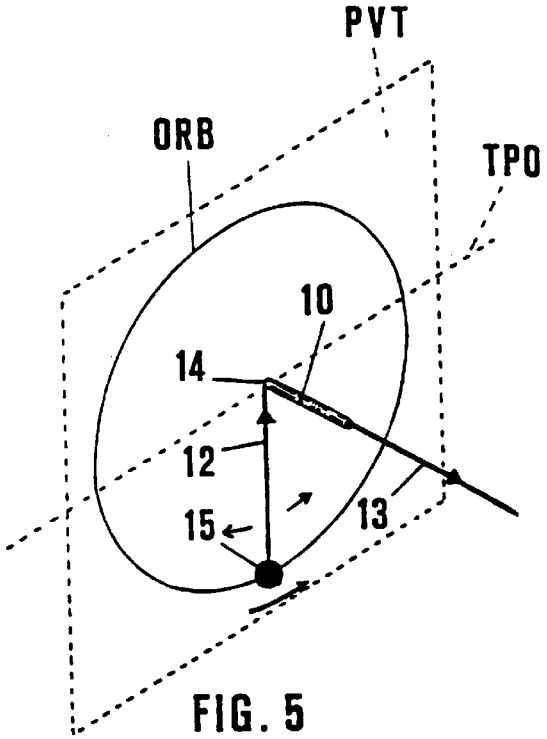
Figure 6:
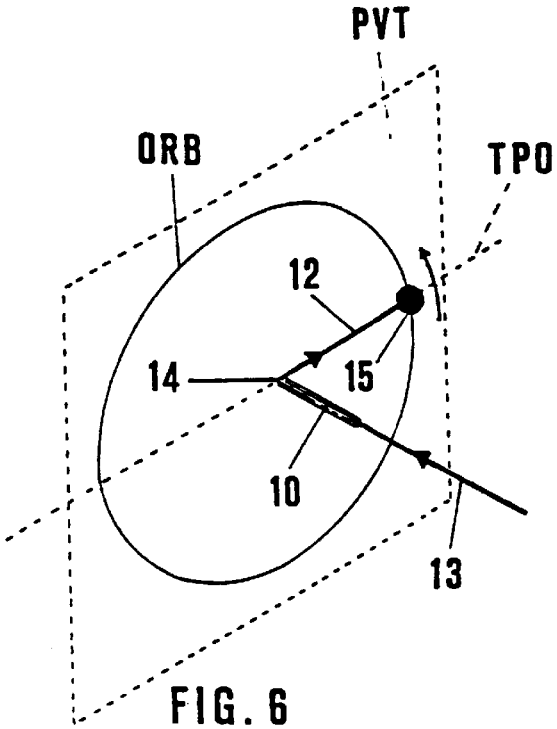
Figure 7:
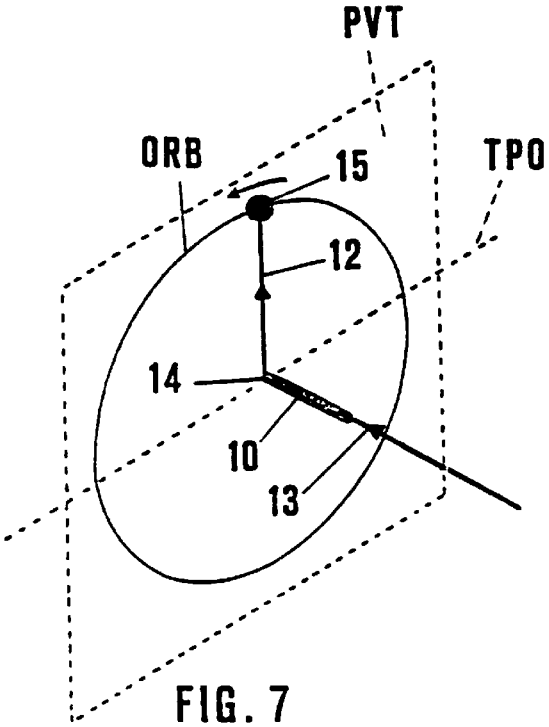

As already mentioned, the system is supposed to be in the starting condition, that could be the one shown in FIG. 5, wherein sleeve 10 is kept. in a horizontal position by left hand MSX of the device user (FIG. 2) and body 15 is secured to outer string length 12, which is placed along the vertical line, that is the gravity line passing through mouth 14.

Body 15 will be then caused to oscillate with a pendular movement with respect to the vertical line, as indicated by the short arrows of opposite direction, and then inner string length 13 will be abruptly pulled as body 15 is covering the length of the pendular movement oriented in the same direction in which body 15 should be rotated.

Assuming that the body has been caused to rotate in the direction shown by the arrows in FIGS. 4–7, in order to maintain the rotation of the body, inner string length 13 is pulled, as body 15 is covering orbit length ORB comprised in lower quadrants III and II, and then released, as body 15 is covering the orbit length comprised in upper quadrants I and IV (FIG. 3), assuming that the movement occurs along a circular orbit rather than along an eccentric orbit, as it is in reality.

In other words, string 13 is pulled when body. 15 is moving below the horizontal plane and it is released when body 15 is moving thereabove.

Figure 3:
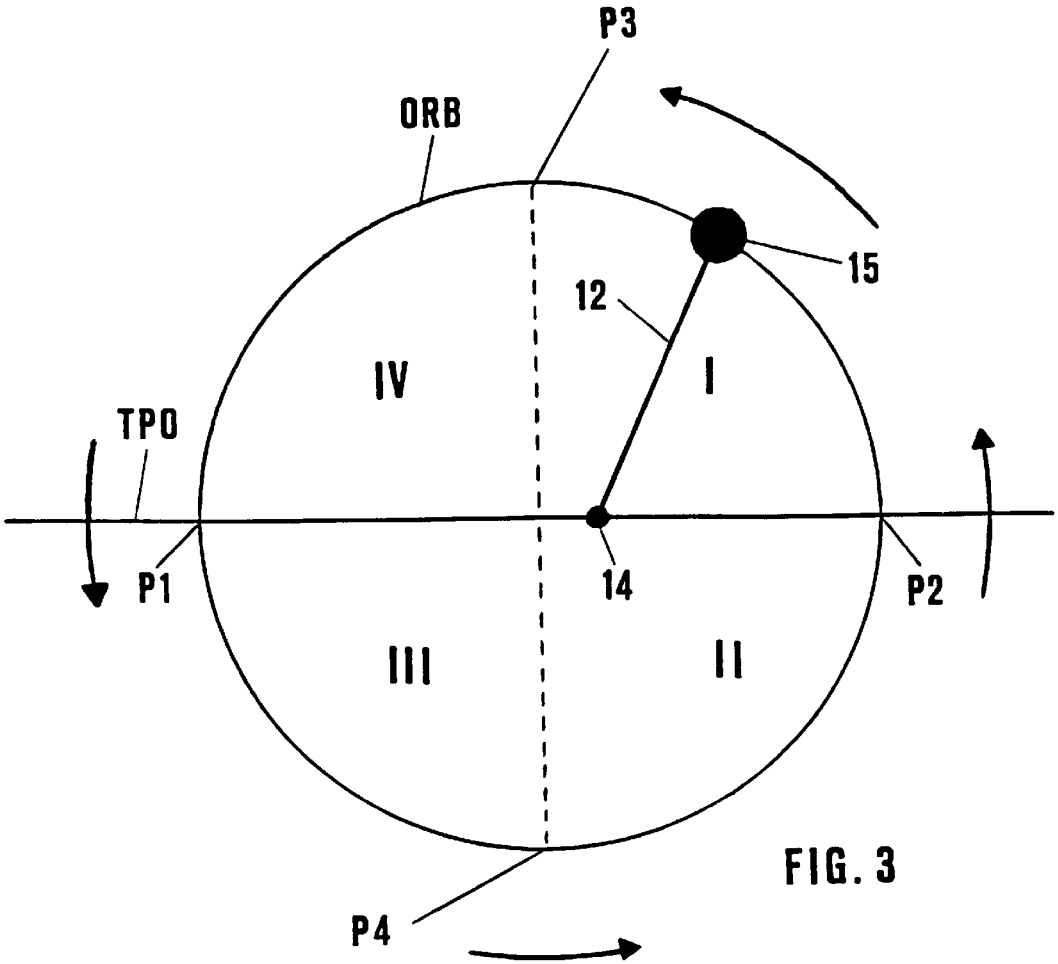
FIG. 3 is a schematical view of FIG. 2 drawn on the plane of the drawing, with parts omitted for the sake of clarity.
Figure 4:
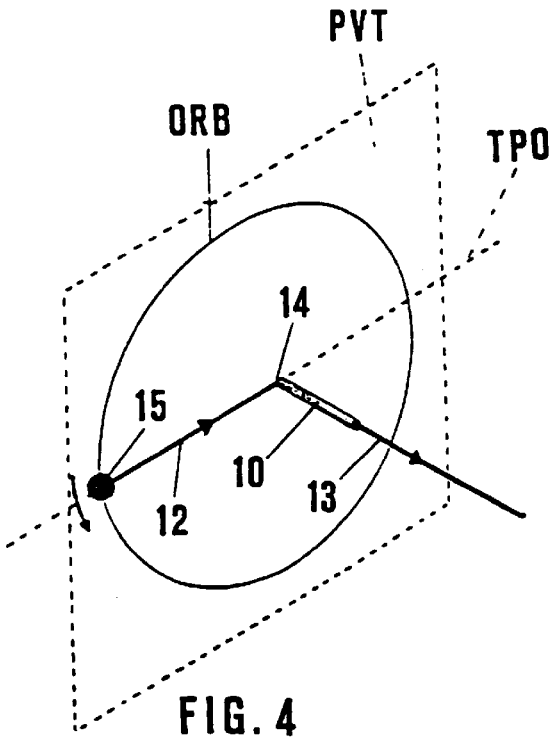

Considering the phenomenon with reference to FIG. 3, it has been found that, starting from the horizontal position P1 of the string-body system, such as that body 15 has the same level as center of revolution 14, if string 13 is shortened, as soon as the body begins its downwardly oscillation by gravity between positions P1 and P4, thus causing the body to get closer to its center of revolution, it will be observed that, as body 15 covers its orbit ORB downwardly it increases its speed then reaching, after having covered its orbit upwardly between positions P4 and P2, the minimum distance from center 14, namely position P2 that is diametrically opposed to position P1.

Releasing now string 13, body 15 will move away from its center of revolution 14 and, owing to the kinetic energy acquired, will continue to move upwardly between positions P2 and P3 above center 14 about which it rotates, gradually decreasing its speed. Body 15 finally covers the downwardly directed path length between positions P3 and P1, continuing to move away from its canter of revolution, until it reaches again position P1, from which the movement had started.

When body 15 has reached position P1 the firstly described step of the cycle can be repeated again and again so that, in successive steps, the revolution can be maintained indefinitely. It should be also noted that the angular speed of body 15 covering orbit ORB can be controlled through the intensity of the pulling and releasing actions exerted on string length 13.

In case the invention is used as a toy, since very high speeds can be reached, it will be advisable to cover the body with a soft material, such as a sponge material.

Figure 2:
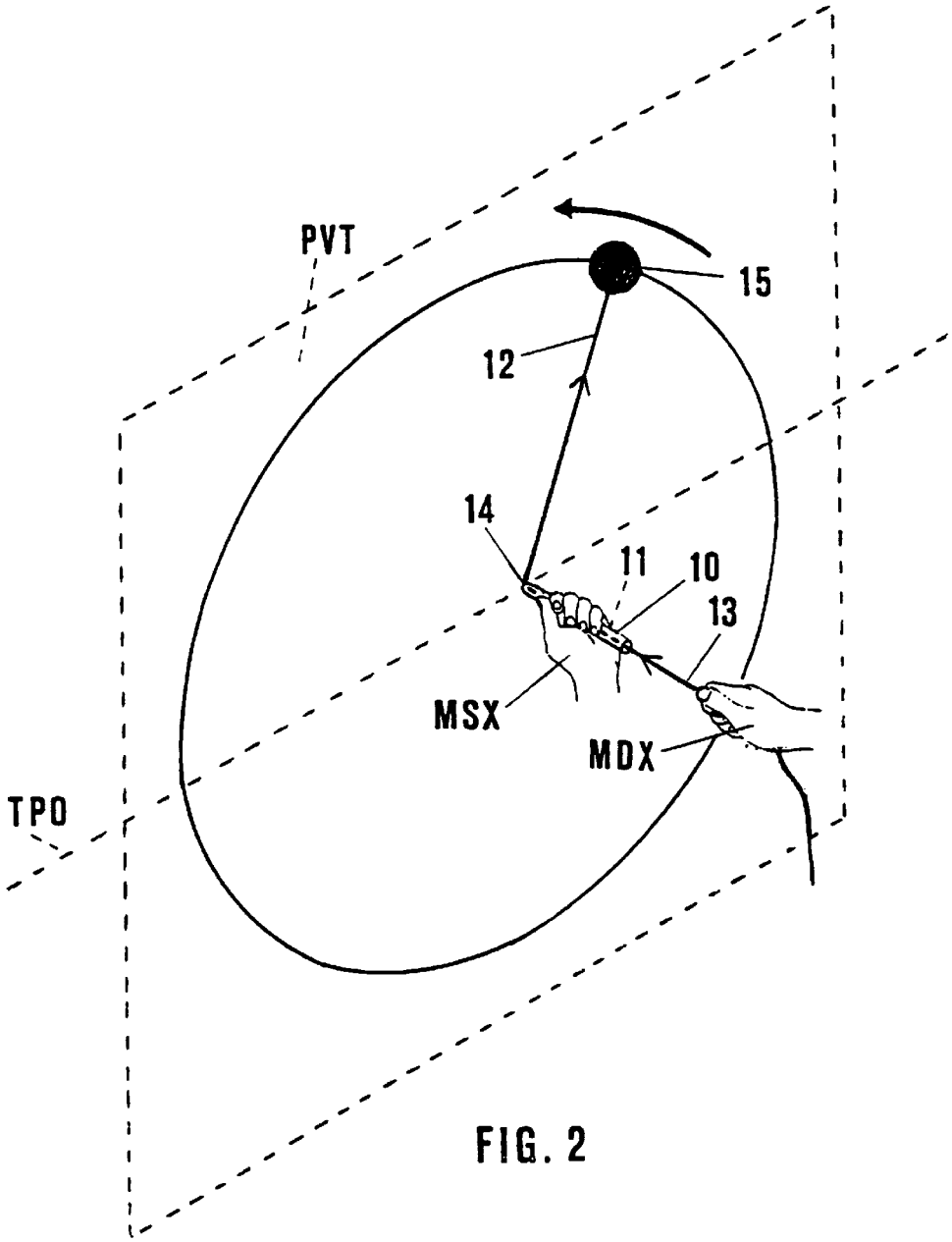
FIG. 2 is a similar view wherein the vertical plane of revolution and the path of the horizontal plane are represented.

Finally, in the illustrated embodiment, mouth 14 of sleeve or pipe 10 is preferably flared as a trumpet, as shown in FIG. 2 only, in order to avoid a fast wear and consequent rupture of string length 12.

I claim:

1. A method of operating a rotating toy comprising the steps of:

(a) providing a hollow member having a first end and a second end for holding in a substantially horizontal position;

(b) providing a constraint threaded through said hollow member, a first portion of said constraint extending from the first end of said hollow member having a body attached to an end of the first portion of said constraint, a second portion of said constraint threaded through said hollow member, and a third portion of said constraint having a free end extending from the second end of said hollow member;

(c) holding said hollow member in a substantially horizontal position;

(d) swinging the body attached to the end of the first portion of said constraint in a pendular motion; and (e) pulling and releasing the third portion of said constraint adjacent the free end to vary the length of the first portion of said constraint causing said body to rotate about the first end of said hollow member.

2. The method of claim 1 wherein step (a) comprises providing a hollow member having a flared first end and a second end for holding in a substantially horizontal position.

3. The method of claim 1 wherein in step (e) the first portion of said constraint is adapted to be rhythmically shortened and lengthened causing said body to rotate about the first end of said hollow member.

4. The method of claim 1 wherein step (e) comprises pulling the third portion of said constraint adjacent the free end when said body is moving below a horizontal plane of said hollow member and releasing the third portion of said constraint adjacent the free end when said body is moving above the horizontal plane.

5. A method of rotating a soft body about a stationary center comprising the steps of:

(a) providing a tube having a first end and a second end;

(b) providing a soft body;

(c) providing a length of string threaded through said tube, a first portion of said string extending from the first end of said tube having said soft body attached thereto, and a second portion of said string having a free end extending from the second end of said tube;

(d) grasping said tube with a hand such that the first portion of said string hangs from the first end of said tube;

(e) swinging said soft body in a pendular motion; and (f) pulling the second portion of said string adjacent the free end with another hand when said soft body is moving below a horizontal plane of said tube and releasing the second portion of said string adjacent the free end when said soft body is moving above the horizontal plane.

* * * * *

UNITED STATES PATENT AND TRADEMARK OFFICE

CERTIFICATE OF CORRECTION

PATENT NO. : 6,004,184

DATED : December 21, 1999

INVENTOR(S) : Piluso

It is certified that error appears in the above-identified patent and that said Letters Patent is hereby corrected as shown below:

Col. 1, line 26, delete "shorts" and substitute therefore - - short - -

Col. 1, line 65, delete "i n" and substitute therefore - - in- -

Col. 2, line 36, delete "canter" and substitute therefore - - center- -

Col. 2, line 53, after "kept" delete - - . - -

Col. 3, line 6, after "body" delete - - . - -

Col. 3, line 27, delete "canter" and substitute therefore - - center - -

Signed and Sealed this

First Day of August, 2000

*Attest:*

Q. TODD DICKINSON

*Attesting Officer*

*Director of Patents and Trademarks*